United States Patent [19]

Shulman et al.

[11] Patent Number: 4,842,769

[45] **Date of Patent: * Jun. 27, 1989**

[54] STABILIZED FABRIC SOFTENING BUILT DETERGENT COMPOSITION CONTAINING ENZYMES

[75] Inventors: Jan E. Shulman, Old Bridge; Pallassana Ramachandran, Robbinsville, both of N.J.

[73] Assignee: Colgate-Palmolive Co., Piscataway, N.J.

[ * ] Notice: The portion of the term of this patent subsequent to Jun. 27, 2006 has been disclaimed.

[21] Appl. No.: 153,362

[22] Filed: Sep. 2, 1987

Related U.S. Application Data

[63] Continuation of Ser. No. 792,710, Oct. 30, 1985, abandoned, which is a continuation-in-part of Ser. No. 759,523, Jul. 26, 1985, abandoned.

[51] Int. Cl.[4] ..... C11D 3/06; C11D 3/386; D06M 11/00

[52] U.S. Cl. ..... 252/8.6; 252/173; 252/174.12; 252/174.19; 252/174.24; 252/174.14; 252/534; 252/553; 252/DIG. 14; 252/DIG. 12; 252/174.25, 8/137

[58] Field of Search ..... 252/8.6, 8.7, 174.12, 252/174.21, 174.25, 532, 534, 539, 546, DIG. 12, DIG. 14

[56] References Cited

U.S. PATENT DOCUMENTS

| | | | |
|---|---|---|---|
| 4,465,619 | 8/1984 | Boskamp | 252/540 |
| 4,469,605 | 9/1984 | Ramachandran | 252/8.7 |
| 4,507,219 | 3/1985 | Hughes | 252/118 |
| 4,518,694 | 5/1985 | Shaer | 435/188 |
| 4,529,525 | 7/1985 | Dormal et al. | 252/132 |
| 4,532,064 | 7/1985 | Boskamp | 252/105 |
| 4,537,706 | 8/1985 | Severson | 252/545 |
| 4,537,707 | 8/1985 | Severson | 252/545 |
| 4,537,708 | 8/1985 | Downey et al. | 252/554 |

FOREIGN PATENT DOCUMENTS

| | | |
|---|---|---|
| 126505 | 11/1984 | European Pat. Off. . |
| 2079305 | 1/1982 | United Kingdom . |
| 2140818 | 12/1984 | United Kingdom . |
| 2140819 | 12/1984 | United Kingdom . |

*Primary Examiner*—Prince E. Willis

*Attorney, Agent, or Firm*—Bernard Lieberman; Murray M. Grill

[57] ABSTRACT

A stabilized enzyme-containing built liquid detergent is provided comprising (a) from about 5 to 20%, by weight, of one or more surface active detergent compounds selected from the group consisting of anionic, nonionic and amphoteric detergent compounds;

from about 5 to 30%, by weight, of one or more builder salts selected from the group consisting of alkali metal tripolyphosphates, alkali metal carbonates, alkali metal nitrilotriacetates and polyacetal carboxylates;

(c) from about 5 to 20%, by weight, of a swelling bentonite clay;

(d) an effective amount of an enzyme or an enzyme mixture selected from the group consisting of alkaline protease enzymes and alpha-amylase enzymes;

(e) an enzyme-stabilizing system containing, based on the weight of the detergent composition, (i) from about 1% to 10% glycerine; (ii) from about 1 to 8% of a boron compound selected from the group consisting of boric acid, boric oxide and alkali metal borates; and (iii) from about 0.5 to 8% of a carboxylic acid compound selected from the group consisting of mono, di and/or polycarboxylic acids having 1 to 8 carbon atoms and water-soluble salts thereof; and (f) the balance comprising water.

22 Claims, No Drawings

STABILIZED FABRIC SOFTENING BUILT DETERGENT COMPOSITION CONTAINING ENZYMES

CROSS REFERENCE TO RELATED APPLICATION

This application is a continuation application Ser. No. 792,710, filed Oct. 30, 1985 which in turn is a continuation-in-part of Ser. No. 759,523 filed 7/26/85 both abandoned.

This application is related to copending U.S. application Ser. No. 759,528, filed on July 26, 1985, which discloses an enzyme containing built liquid detergent composition containing defined amounts of surfactant and builder, and a defined enzyme stabilizing system comprising glycerine, a boron compound and a polycarboxylic acid compound.

BACKGROUND OF THE INVENTION

This invention relates to stable, built, enzyme-containing liquid detergent compositions suitable for laundry or pre-soak formulations. More particularly, the invention relates to aqueous enzyme-containing liquid detergent compositions which contain one or more detergent builders and which are characterized by being physically stable, homogeneous liquid compositions.

The formulation of stabilized enzyme-containing liquid detergent compositions has been the focus of much attention in the prior art. The desirability of incorporating enzymes into detergent compositions is primarily due to the effectiveness of proteolytic and amylolytic enzymes in decomposing proteinaceous and starch materials found on soiled fabrics, thereby facilitating the removal of stains, such as, gravy stains, blood stains, chocolate stains and the like during laundering. However, enzymatic materials suitable for laundry compositions, particularly proteolytic enzymes, are relatively expensive. Indeed, they generally are among the most expensive ingredients in a typical commercial liquid detergent composition, even though they are present in relatively minor amounts. Moreover, enzymes are known to be unstable in aqueous compositions. It is for this reason that an excess of enzymes is generally required in liquid detergent formulations to compensate for the expected loss of enzyme activity during prolonged periods of storage. Accordingly, the prior art is replete with suggestions for stabilizing enzyme-containing liquid detergent compositions, and in particular unbuilt liquid compositions by the use of various materials which are incorporated into the composition to function as enzyme stabilizers.

In the case of liquid detergent compositions containing a builder, the problem of enzyme instability is particularly acute. Primarily this is because detergent builders have a destabilizing effect on enzymes, even in compositions containing enzyme stabilizers which are otherwise effective in unbuilt formulations. Moreover, the incorporation of a builder into a liquid detergent composition poses an additional problem, namely, the ability to form a stable single-phase composition; the solubility of sodium tripolyphosphate, for example, being relatively limited in aqueous compositions, and especially in the presence of anionic and nonionic detergents.

In U.K. Patent Application G.B. No. 2,079,305, published Jan. 20, 1982, there is disclosed an aqueous built enzyme-containing liquid detergent composition which is stabilized by a mixture of a polyol and boric acid. As noted in the examples of the U.K. application, relatively large amounts of glycerol are required to stabilize the enzymes in the composition. Yet, as demonstrated hereinafter in the present specification, the enzyme stabilizing effect provided by a mixture of glycerine and borax in a built aqueous liquid detergent composition is relatively modest.

In European Patent Application Publication No. 0126505, there is disclosed an aqueous enzyme-containing liquid detergent composition containing an enzyme stabilizing mixture consisting of certain dicarboxylic acids and borax. The dicarboxylic acids are recommended as a substitute for a polyol such as glycerol in known enzyme stabilizing mixtures consisting of glycerol and a boron compound. However, such dicarboxylic acid-borax mixtures in common with the aforementioned mixtures of glycerine and borax are also incapable of providing anything other than a modest stabilizing effect in the present built liquid detergent compositions.

SUMMARY OF THE INVENTION

The present invention provides a stabilized fabric softening built, enzyme-containing liquid detergent composition comprising:

(a) from about 5 to 20%, by weight, of one or more surface active detergent compounds selected from the group consisting of anionic, nonionic and amphoteric detergent compounds;

(b) from about 5 to 30%, by weight, of one or more builder salts selected from the group consisting of alkali metal tripolyphosphates, alkali metal carbonates, alkali metal nitrilotriacetates, and polyacetal carboxylates.

(c) from about 5 to 20%, by weight, of a swelling bentonite clay;

(d) an effective amount of an enzyme or an enzyme mixture selected from the group consisting of alkaline protease enzymes and alpha-amylase enzymes;

(e) an enzyme-stabilizing system containing, based on the weight of the detergent composition, (i) from about 1 to 10% glycerine; (ii) from about 1 to 8% of a boron compound selected from the group consisting of boric acid, boric oxide and alkali metal borates and; (iii) from about 0.5 to 8% of a carboxylic acid compound selected from the group consisting of mono, di and/or polycarboxylic acids having 1 to 8 carbon atoms and water-soluble salts thereof; and (f) the balance comprising water and optionally perfume and other adjuvants.

In a preferred embodiment of the invention, the liquid detergent composition comprises (a) from about 5 to 15% of an alkali metal alkylbenzene sulfonate wherein the alkyl group contains 12 to 15 carbon atoms;

(b) from about 0.5 to 5% of an alkali metal alkyl polyethoxy sulfate wherein the alkyl group contains 10 to 18 carbon atoms and the polyethoxy is of 3 to 11 ethylene oxide groups, the weight ratio of (a) to (b) being from about 2:1 to about 6:1;

(c) from about 5 to 20% of sodium tripolyphosphate;

(d) from about 1 to 10% of sodium carbonate, sodium bicarbonate or mixtures thereof, the weight ratio of (c) to (d) being from about 2:1 to about 6:1;

(e) from about 10 to 15% of a sodium bentonite;
(f) an effective amount of the aforesaid enzyme or enzyme mixture;
(g) an enzyme stabilizing system containing, based on the weight of the detergent composition, (i) from about 1 to 5% glycerine (ii) from about 1 to 5% of an alkali metal borate and (iii) from about 0.5 to 4% of said carboxylic acid compound; and
(h) the balance comprising water and optionally perfume and other adjuvants In accordance with the process of the invention, laundering of stained and/or soiled materials is affected by contacting such materials with an aqueous solution of the above-defined liquid detergent compositions.

The described liquid detergent is a commercially acceptable heavy duty laundry detergent, capable of satisfactorily cleaning laundry items containing both oily and particulate soils. Additionally, the described compositions may be employed for the pre-treatment of badly soiled areas, such as collars and cuffs, of items to be launered.

The present invention is predicated upon the discovery of a three component enzyme stabilizing system as herein defined which provides an enzyme stabilizing effect to the liquid detergent compositions of the invention far in excess of that which can be achieved with conventional enzyme stabilizers. The enzyme stabilizing effect thus achieved reflects a synergy among the three components. In accordance with the invention, the enzyme stability provided by a mixture of glycerine and borax or a mixture of borax and a dicarboxylic acid as disclosed in the prior art can be synergistically improved by the use of the three component stabilizing system herein defined in the present liquid compositions so as to raise the level of enzyme stability significantly above that provided by either the mixture of glycerine and borax or the mixture of borax and dicarboxylic acid when used independently of each other as enzyme stabilizers. For commercial purposes, a desirable enzyme stability generally corresponds to about a half-life of one week at a temperature of 110° F.

DETAILED DESCRIPTION OF THE INVENTION

The enzyme stabilizing system of the invention is a mixture of glycerine, a boron compound selected from among boric acid, boric oxide and an alkali metal borate and a carboxylic acid compound as herein defined. The weight of the stabilizing system in the present built liquid detergent compositions is generally from about 3 to 25%, preferably about 6 to 15%, by weight. The weight ratio of glycerine to borax in the stabilizing mixtures is generally from about 0.5 to 3. The preferred amount of glycerine in the composition is from about 1 to 5%, the preferred amount of boron compoumd is from about 1 to 5%, and the preferred amount of carboxylic compound is from about 0.5 to 4% based on the weight of the composition.

The carboxylic acid compounds which are useful in the enzyme stabilizing system of the invention encompass saturated as well as unsaturated mono, di and polycarboxylic acids having 1 to 8 carbon atoms among which are included oxalic acid (HOOCCOOH), malonic acid ($HOOCCH_2COOH$), maleic acid (HOOCCH:CHCOOH) and succinic acid ($HOOCCH_2CH_2COOH$). The carboxylic acids may contain hydroxy or amino substitutents as exemplified by malic acid ($HOOCCHOHCH_2COOH$), tartaric acid (dihydroxysuccininc acid) aspartic acid (amino succinic acid) and citric acid. Preferred carboxylic acids of the invention are aspartic acid, tartaric acid, malonic acid and malic acid. From a commercial standpoint, a particularly preferred carboxylic acid compound is citric acid and/or its salts because of their relatively low cost.

The alkaline proteolytic enzymes suitable for the present compositions include the various commercial liquid enzyme preparations which have been adapted for use in detergent compositions. Enzyme preparations in powdered form are also useful although, as a general rule, less convenient for incorporation into the built liquid detergent compositions. Thus, suitable liquid enzyme preparations include "Alcalase" and "Esperase" sold by Novo Industries, Copenhagen, Denmark, and "Maxatase" and "AZ-Protease" sold by Gist-Brocades, Delft, The Netherlands.

Among the suitable α-amylase liquid enzyme preparations are those sold by Novo Industries and Gist-Brocades under the tradenames "Termamyl" and "Maxamyl", respectively.

"Esperase" is particularly preferred for the present compositions because of its optimized activity at the higher pH values corresponding to the built detergent compositions.

The preferred detergents for use in the present liquid compositions are the synthetic anionic detergent compounds, and particularly a mixture of higher alkylbenzene sulfonate and alkyl polyethoxy sulfate. While other water soluble higher alkylbenzene sulfonates may also be present in the instant formulas, such as potassium salts and in some instances the ammonium or alkanolammonium salts, where appropriate, it has been found that the sodium salt is highly preferred, which is also the case with respect to the alkyl polyethoxy sulfate detergent component. The alkylbenzene sulfonate is one wherein the higher alkyl is of 12 to 15 carbon atoms, preferably 13 carbon atoms. The alkyl polyethoxy sulfate, which also may be referred to as a sulfated polyethoxylated higher linear alcohol or the sulfated condensation product of a higher fatty alcohol and ethylene oxide or polyethoxylene glycol, is one wherein the alkyl is of 10 to 18 carbon atoms, preferably 12 to 15 carbon atoms, e.g., about 13 carbon atoms, and which includes 3 to 11 ethylene oxide groups, preferably 3 to 7, more preferably 3 to 5 and most preferably 3 or about 3 ethylene oxide groups. The ratio of alkylbenzene sulfonate to polyethoxy sulfate in the detergent mixture is preferably from about 2:1 to 6:1 and most preferably from about 2:1 to 4:1, by weight. At ratios above 5:1, the physical stability of the product may be adversely affected.

In suitable circumstances other anionic detergents, such as fatty alcohol sulfates, paraffin sulfonates, olefin sulfonates, monoglyceride sulfates, sarcosinates and similarly functioning detergents, preferably as the alkali metal. e.g., sodium salts, can be present, sometimes in partial replacement of the previously mentioned synthetic organic detergents but usually, if present, in addition to such detergents. Normally the supplementing detergents will be sulfated or sulfonated products (usually as the sodium salts) and will contain long chain (8 to 20 carbon atoms) linear or fatty alkyl groups. In addition to any supplementing anionic synthetic organic detergents, there also may be present nonionic and amphoteric materials, like the Neodols,® sold by Shell Chemical Company, which are condensation products of ethylene oxide and higher fatty alcohols. e.g., Neodol® 23-6.5, which is a condensation product of a higher fatty alcohol of about 12 to 13 carbon atoms with about 6.5 moles of ethylene oxide. Illustrations of the various detergents and classes of detergents mentioned may be found in the text *Surface Active Agents,* Vol. II, by Schwartz, Perry and Berch (Interscience Publishers, 1958), the descriptions of which are incorporated herein by reference.

The builder salt combination of this invention, which has been found to satisfactorily improve the detergency of the mixture of synthetic anionic organic detergents and produce the desired pH in the liquid detergent and in the wash water, is a mixture of sodium tripolyphosphate and sodium carbonate. The builder salts are employed in the present compositions in amounts generally of from about 5 to 25%, by weight. For the preferred builder salt combination, sodium tripolyphosphate is present in amounts of from about 5 to 20%, preferably 10 to 16%, and sodium carbonate is present from about 1 to 10%, by weight, preferably 3 to 7%, the weight ratio of tripolyphosphate to carbonate in the preferred builders mixtures being from about 2:1 to 6:1, and most preferably from about 2:1 to 4:1. As used herein, the term alkali metal "carbonates" or "carbonate" is meant to include the carbonates, bicarbonates and sesquicarbonates of such alkali metal.

For best processing, easier mixing and good end-use properties it is preferred that the sodium tripolyphosphate be low in content of Phase I type tripolyphosphate. Thus, normally the content of Phase I type tripolyphosphate will be less than 30% of the tripolyphosphate employed. Although in some instances incompletely neutralized tripolyphosphate may be used, normally the phosphate employed may be considered as being pentasodium tripolyphosphate, $Na_5P_3O_{10}$. Of course, in some instances, as when potassium salts of other materials are present, ion interchange in an aqueous medium may result in other salts than the sodium tripolyphosphate being present but for the purpose of this specification it will be considered that sodium tripolyphosphate, as the pentasodium salt, the material which is normally charged to the mixer to make the present liquid detergent, is the tripolyphosphate employed.

Other preferred builder salts which may be used in place of sodium tripolyphosphate and sodium carbonate or in addition thereto include a polyacetal carboxylate as herein described and sodium nitrilotriacetate (NTA). Of course, various mixtures of the mentioned water soluble builder salts can be utilized. Yet, the tripolyphosphate-carbonate mixture described has been found to be most preferred, although the other builders and mixtures thereof are also operative. Other builders which may be employed as supplements, in addition to the proportions of the above mentioned builders, include other phosphates, such as tetrasodium pyrophosphate or tetrapotassium pyrophosphate, sodium bicarbonate, sodium citrate, sodium gluconate, sodium silicate, and sodium sesquicarbonate. Among the water insoluble builders that may be used are the zeolites, such as Zeolite A, usually in the form of its crystalline hydrate, although amorphous zeolites may also be useful.

Polyacetal carboxylates are generally described in U.S. Pat. Nos. 4,144,226 and 4,315,092. U.S. Pat. No. 4,146,495 describes detergent compositions containing polyacetal carboxylates as builders.

The polyacetal carboxylates which are useful herein as builders may be considered to be those described in U.S. Pat. No. 4,144,226 and may be made by the method mentioned therein. A typical such product will be of the formula

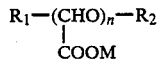

wherein M is selected from the group consisting of alkali metal, ammonium, alkyl groups of 1 to 4 carbon atoms, tetraalkylammonium groups and alkanolamine groups, both of 1 to 4 carbon atoms in the alkyls thereof, n averages at least 4, and $R_1$ and $R_2$ are any chemically stable groups which stabilize the polymer against rapid depolymerization in alkaline solution. Preferably the polyacetal carboxylate will be one wherein M is alkali metal, e.g., sodium, n is from 50 to 200, $R_1$ is

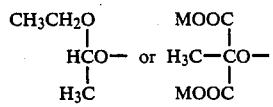

or a mixture thereof, $R_2$ is

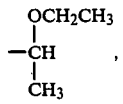

and n averages from 20 to 100, more preferably 30 to 80. The calculated weight average molecular weights of the polymers will normally be within the range of 2,000 to 20,000, preferably 3,500 to 10,000 and more preferably 5,000 to 9,000, e.g., about 8,000.

A particularly preferred sodium polyacetal carboxylate is supplied by Monsanto Company and is known as Builder U. It has a calcuated average molecular weight of about 8,000 and an active polymer content of about 80%.

Although the preferred polyacetal carboxylates have been described above, it is to be understood that they may be wholly or partially replaced by other such polyacetal carboxylates or related organic builder salts described in the previously cited patents on such compounds, processes for the manufacture thereof and compositions in which they are employed. Also, the chain terminating groups described in the various patents, especially U.S. Pat. No. 4,144,226, may be utilized, providing that they have the desired stabilizing properties, which allow the mentioned builders to be depolymerized in acidic media, facilitating biodegradation thereof in waste streams, but maintain their stability in alkaline media, such as washing solutions.

The bentonite employed herein is a colloidal clay (aluminium silicate) containing montmorillonite. Swelling bentonites are generally characterized as sodium bentonites, i.e., bentonite wherein the predominant cation is sodium. Among the sodium bentonite clays, those from Wyoming (generally referred to as Western or Wyoming bentonite) are especially preferred.

The swelling capacity of bentonite is generally associated with its fabric softening properties. In water the swelling capacity of sodium bentonite is in the range of 3 to 20 milliliters/gram, preferably 7 to 15 ml/gram, and its viscosity, at 6% concentration in water, is usually in the range of 3 to 30 centipoises, preferably 8 to 30 centipoises.

Preferred swelling bentonites are sold under the trademark HI-JEL by Georgia Kaolin Co. These materials are the same as bentonites which are formerly sold under the trademarks MINERAL COLLOID and THIXO-JEL. They are selectively mined and beneficiated bentonites, and those considered to be most useful are available as HI-JEL Nos. 1,2,3 etc., corresponding to THIXO-JELs No's 1,2,3 and 4. Such materials have a maximum free moisture content (before addition to the liquid medium) of 4% to 8% and specific gravities of about 2.6. The bentonite is preferably one which will pass through a 200 mesh U.S. Sieve Series sieve, and most preferably at least 90% of the particles will pass through a No. 325 sieve, so that the equivalent diameter of the bentonite may be considered to be less than 74 microns, and more preferably less than about 44 microns.

Typical chemical analyses of some bentonites that are useful for making the present liquid detergents show that they contain from 64.8 to 73.0% of $SiO_2$, 14 to 18% of $Al_2O_3$, 1.6 to 2.7% of MgO, 1.3 to 3.1% of CaO, 2.3 to 3.4% of $Fe_2O_3$, 0.8 to 2.8% of $Na_2O$ and 0.4 to 7.0% of $K_2O$.

Although the western bentonites are preferred it is also possible to utilize other bentonites, such as those which may be made by treating Italian or similar bentonites containing relatively small proportions of exchangeable monovalent metals (sodium and potassium) with alkaline materials, such as sodium carbonate, to increase the cation exchange capacities of such products. It is considered that the $Na_2O$ content of the bentonite should be at least about 0.5%, preferably at least 1% and more preferably at least 2% so that the clay will be satisfactorily swelling, with good softening and dispersing properties in aqueous suspension. Preferred swelling bentonites of the types described above are sold under the trade names Laviosa and Winkelmann, e.g., Laviosa AGB and Winkelmann G-13.

Other bentonites which are particularly useful for the present liquid detergent compositions because of their white or very light color include American Colloid Company's Polarite KB 325, a California bentonite, and Georgia Kaolin's GK 129, a Mexican bentonite.

The viscosity of the present liquid detergent is normally in the range of about 1000 to 10,000 centipoises, preferably 2000–7000 centipoises, but products of other suitable viscosities may also be useful. At the viscosities mentioned, the liquid detergent is pourable, stable, nonseparating and uniform. The pH of the liquid detergent suspension usually in the range of 7 to 11.5, preferably 8 to 10.5, appears to help to maintain product stability and pourability.

The following examples illustrate but do not limit the invention. Unless otherwise indicated all parts are by weight and temperatures are in °C.

EXAMPLE 1

| Component | Percent |
|---|---|
| Pentasodium tripolyphosphate | 11.0 |
| Bentonite (Georgia-Kaolin 129) | 12.0 |
| Sodium carbonate | 2.0 |
| Sodium sesquicarbonate | 2.0 |
| Sodium linear tridecylbenzene sulfonate | 8.0 |
| AEOS[1] | 3.0 |

-continued

| Component | Percent |
|---|---|
| Carboxymethyl cellulose (CMC) | 0.2 |
| Optical brightener | 0.3 |
| Perfume | 0.4 |
| Enzyme (Esperase 8.0L)[2] | 1.0 |
| Glycerine | 3.0 |
| Borax | 2.5 |
| Citric Acid | 2.0 |
| Water and ajuvants | Balance |

[1]Sodium alkyl polyethoxy sulfate wherein the alkyl is 12 to 15 carbon atoms and the polyethoxy is 3 ethoxy groups.
[2]"Esperase" sold by Novo Industries having an activity of 8.0 KNPU/gram The composition shown above was prepared by the following procedure: 30.0 parts of deionized water at 40° F. are added to a suitable mixing apparatus such as a vertical cylindrical tank equipped with a stirrer. With the stirrer adjusted for medium agitation, a mixture consisting of 2.0 parts anhydrous soda ash, 2.0 parts sodium sesquicarbonate, and 0.2 parts sodium carboxymethyl cellulose is incorporated into the water. The stirrer speed is then increased to maximum agitation and a mixture comprised of 11.0 parts pentasodium tripolyphosphate and 12.0 parts bentonite is slowly added to the mixing apparatus over a period of 10–15 minutes to form an off-white suspension. The agitation speed is then decreased to a slow/medium setting while 8.64 parts of high AI (about 55%) LTBS slurry is added. Thereafter the optical brightener/color solution is added consisting of 0.3 parts Tinopal LMS-X (CIBA-GEIGY), 0.99 parts colorant, and 4.02 parts deionized water. Once a uniform blueish-green colored solution is obtained, 0.4 parts of perfume are added to the mixture under agitation. This is followed by the slow addition of 3.0 parts glycerine and 2.5 parts borax as a two component slurry. Stirring is continued until the mixture is uniform in appearance and then 2.0 parts of citric acid and 9.0 parts water are slowly added. Agitation of the mixture is then reduced while 10.95 parts of a mixed AI detergent base consisting of an LTBS slurry (about 30% AI) and AEOS (about 27.5% AI) is added to the mixture. This is followed by the slow addition of 1.0 part proteolytic enzyme with continuous agitation until all materials are completely dispersed or dissolved.

EXAMPLE 2

Enzyme-containing built liquid detergent compositions A to G were formulated as set forth below in Table 1. The percentages shown indicate weight percent. The arrows are meant to indicate the extent to which Compositions B to G are identical to Composition A.

TABLE 1

| Component | A | B | C | D | E | F | G |
|---|---|---|---|---|---|---|---|
| Pentasodium Tripolyphosphate | 11.0 | ↓ | ↓ | ↓ | ↓ | ↓ | ↓ |
| Bentonite (Georgia-Kaolin 129) | 12.0 | ↓ | ↓ | ↓ | ↓ | ↓ | ↓ |
| Sodium Carbonate | 2.0 | ↓ | ↓ | ↓ | ↓ | ↓ | ↓ |
| Sodium sesquicarbonate | 2.0 | ↓ | ↓ | ↓ | ↓ | ↓ | ↓ |
| Sodium linear tridecyl-benzene sulfonate | 8.0 | ↓ | ↓ | ↓ | ↓ | ↓ | ↓ |
| AEOS[1] | 3.0 | ↓ | ↓ | ↓ | ↓ | ↓ | ↓ |
| Optical brightener (Tinopal LMS-X) | 0.3 | ↓ | ↓ | ↓ | ↓ | ↓ | ↓ |
| Perfume | 0.4 | ↓ | ↓ | ↓ | ↓ | ↓ | ↓ |
| CMC | 0.2 | ↓ | ↓ | ↓ | ↓ | ↓ | ↓ |
| Enzyme[2] | 1.0 | ↓ | ↓ | ↓ | ↓ | ↓ | ↓ |
| Glycerine | — | 3.0 | — | 3.0 | — | — | 3.0 |
| Borax | — | — | 2.5 | 2.5 | — | 2.5 | 2.5 |
| Carboxylic acid compound | — | — | — | — | 2.0 | 2.0 | 2.0 |

TABLE 1-continued

| Component | A | B | C | D | E | F | G |
|---|---|---|---|---|---|---|---|
| Water and adjuvants | | | | Balance | | | |

(1)Sodium alkyl polyethoxy sulfate wherein the alkyl is 12 to 15 carbon atoms and the polyethoxy is 3 ethoxy groups.
(2)"Esperase" sold by Novo Industries having an activity of 8.0 KNPU/gm (Kilo Novo Protease units/gm)

The enzyme activities of Compositions A to F were tested after 7 days storage at 110°F. The measured enzyme activity for each composition after this period of storage is indicated in Table 2 as a percent of the initial value. The various carboxylic acids and salts used in the general formulas of Compositions A, B, C, D, E, and G are shown in Table 2 as well as the enzyme activities corresponding to each composition.

TABLE 2

ENZYME STABILITY

| Composition | Percent Active Enzyme After 7 Days at 110° F. |
|---|---|
| A (control) | ND* |
| B (with glycerine) | ND |
| C (with borax) | ND |
| D (with glycerine and borax) | 50 |
| Composition E (with carboxylic acid compound) wherein the carboxylic acid compound is: | |
| (1) Succinic acid | ND |
| (2) Malonic acid | " |
| (3) Malic acid | " |
| (4) Tartaric acid | " |
| (5) Aspartic acid | " |
| (6) Citric acid | " |
| (7) Sodium tartrate | " |
| (8) Sodium citrate | " |
| Composition G (with glycerine/borax/carboxylic acid compound) wherein the carboxylic acid compound is: | |
| (1) Succinic acid | 70 |
| (2) Malonic acid | 70 |
| (3) Malic acid | 78 |
| (4) Tartaric acid | 73 |
| (5) Aspartic acid | 90 |
| (6) Citric acid | 74 |
| (7) Sodium tartrate | 66 |
| (8) Sodium citrate | 52 |

*ND = not detectable (below 10% residual activity)

As evident from Table 2, Composition A, the control composition, as well as Compositions B and C containing individual stabilizers of glycerine and borax, respectively, manifested almost no enzyme activity after the 7 day storage period at 100° F. Since enzyme activities below 10% could not be precisely measured they are designated "ND". Composition D containing glycerine/borax in the absence of a carboxylic acid compound provided an improvement in enzyme stability relative to Composition A, but about 50% of the enzyme was deactivated. The various Compositions E containing a variety of carboxylic acid compounds, as indicated, manifested absolutely no improvement in enzyme stability relative to Composition A. However, Compositions G formulated in accordance with the invention demonstrate the unexpected and synergistic improvement in enzyme stability which is achieved with the use of glycerine/borax in combination with a carboxylic acid compound in the present liquid detergent compositions. It is noted that almost every one of the compositions corresponding to Composition G demonstrated a significant improvement in enzyme activity relative to Composition D (containing glycerine and borax).

A comparison of the enzyme activities achieved with Compositions D (glycerine/borax) and various Compositions F (borax/carboxylic acid compound) and G (formulated in accordance with the invention) is set forth below in Table 3.

TABLE 3

ENZYME STABILITY

| Composition | Percent active Enzyme After 7 Days at 110° F. |
|---|---|
| D (Glycerine/borax) | 50 |
| F (Borax/malonic acid) | 45 |
| G (Glycerine/borax/malonic acid) | 70 |
| F (Borax/aspartic acid) | 72 |
| G (Glycerine/borax/aspartic acid) | 90 |
| F (Borax/citric acid) | 42 |
| G (Glycerine/borax/citric acid) | 74 |

As shown in Table 3, the various Compositions G containing a three component stabilizer system in accordance with the invention provided a synergistic improvement in enzyme stability relative to Compositions D and F formulated in accordance with the prior art.

What is claimed is:

1. A stabilized fabric softening enzyme-containing built liquid detergent composition comprising:
   (a) from about 5 to B 20%, by weight, of one or more surface active detergent compounds selected from the group consisting of anionic, nonionic and amphoteric detergent compounds;
   (b) from about 5 to 30%, by weight, of one or more builder salts selected from the group consisting of alkali metal tripolyphosphates, and alkali metal carbonates;
   (c) from about 5 to 20%, of a swelling bentonite clay;
   (d) an effective amount of an enzyme or an enzyme mixture for stain removal selected from the group consisting of alkali protease enzymes and alpha-amylase enzymes;
   (e) an enzyme-stabilizing system containing, based on the weight of the detergent composition, (i) from about 1% to 10% glycerine; (ii) from about 1 to 8% of a boron compound selected from the group consisting of boric acid, boric oxide and alkali metal borates; and (iii) from about 0.5 to 8% of a carboxylic acid compound selected from the group consisting of di and/or polycarboxylic acids selected from the group consisting of oxalic acid, malonic acid, maleic acid, succinic acid, malic acid, tartaric acid, aspartic acid and citric acid and water-soluble salts thereof;
   (f) the balance comprising water.

2. A liquid detergent composition according to claim 1 comprising:
   (a) from about 5 to 15% of an alkali metal alkylbenzene sulfonate wherein the alkyl group contains 12 to 15 carbon atoms;
   (b) from about 0.5 to 5% of an alkali metal alkyl polyethoxy sulfate wherein the alkyl group contains 10 to 18 carbon atoms and the polyethoxy is of 3 to 11 ethylene oxide groups, the weight ratio of (a) to (b) being from about 2:1 to about 6:1;
   (c) from about 5 to 20% of sodium tripolyphosphate;
   (d) from about 1 to 10% of sodium carbonate, sodium bicarbonate or mixtures thereof, the weight ratio of (c) to (d) being from about 2:1 to about 6:1;

(e) from about 10 to 15% of a sodium bentonite;
(f) an effective amount of said enzyme or enzyme mixture;
(g) the enzyme stabilizing system containing, based on the weight of the detergent composition, (i) from about 1 to 5% glycerine (ii) from about 1 to 5% of an alkali metal borate and (iii) from about 0.5 to 4% of said carboxylic acid compound; and
(h) the balance comprising water.

3. A liquid detergent composition according to claim 2 wherein said alkali metal alkylbenzene sulfonate is sodium linear tridecylbenzene sulfonate and said alkali metal alkyl polyethoxy sulfate is one wherein the alkali metal is sodium, the alkyl group contains 12 to 15 carbon atoms and the polyethoxy is of about 3 ethylene oxide groups.

4. A liquid detergent composition according to claim 3 wherein the ratio of tridecylbenzene sulfonate to polyethoxy sulfate is from about 2:1 to about 4:1.

5. A liquid detergent composition according to claim 2 wherein said boron compound is an alkali metal borate.

6. A liquid detergent composition according to claim 5 wherein said borate is borax.

7. A liquid detergent composition according to claim 2 which contains from about 8 to 16% sodium tripolyphosphate and from about 2 to 6% sodium carbonate, sodium bicarbonate or mixtures thereof.

8. A liquid detergent composition according to claim 2 wherein said carboxylic acid compound is aspartic acid or a water-soluble salt thereof.

9. A liquid detergent composition according to claim 2 wherein said carboxylic acid compound is tartaric acid or a water-soluble salt thereof.

10. A liquid detergent according to claim 2 wherein said carboxylic acid compound is citric acid or a water-soluble salt thereof.

11. A liquid detergent composition according to claim 2 wherein said carboxylic acid compound is malonic acid or a water-soluble salt thereof.

12. A liquid detergent composition according to claim 2 wherein said carboxylic acid compound is malic acid or a water-soluble salt thereof.

13. A method of laundering comprising contacting the stained and/or soiled fabrics to be laundered with a stabilized enzyme-containing built liquid detergent composition comprising
(a) from about 5 to 20%, by weight, of one or more surface active detergent compounds selected from the group consisting of anionic, nonionic and amphoteric detergent compounds;
(b) from about 5 to 30%, by weight, of one or more builders salts selected from the group consisting of alkali metal tripolyphosphates, and alkali metal carbonates;
(c) from about 5 to 20%, by weight, of a swelling bentonite clay;
(d) an effective amount of enzyme or an enzyme mixture for stain removal selected from the group consisting of alkaline protease enzymes and alpha-amylase enzymes;
(e) an enzyme-stabilizing system containing, based on the weight of the detergent composition, (i) from 1% to 10% glycerine (ii) from about 1 to 8% of a boron compound selected from the group consisting of boric acid, boric oxide and alkali metal borates; and (iii) from about 0.5 to 8% of a carboxylic acid compound selected from the group consisting of di and/or polycarboxylic acids selected from the group consisting of oxalic acid, malonic acid, maleic acid, succinic acid, malic acid, tartaric acid, aspartic acid and citric acid and water-soluble salts thereof; and
(f) the balance comprising water.

14. A method according to claim 13 wherein said liquid detergent composition comprises:
(a) from about 5 to 15% of an alkali metal alkylbenzene sulfonate wherein the alkyl group contains 12 to 15 carbon atoms;
(b) from about 0.5 to 5% of an alkali metal alkyl polyethoxy sulfate wherein the alkyl group contains 10 to 18 carbon atoms and the polyethoxy is of 3 to 11 ethylene oxide groups, the weight ratio of (a) to (b) being from about 2:1 to about 6:1;
(c) from about 5 to 20% of sodium tripolyphosphate;
(d) from about 1 to 10% of sodium carbonate, sodium bicarbonate or mixtures thereof, the weight ratio of (c) to (d) being from about 2:1 to about 6:1;
(e) from about 10 to 15% of a sodium bentonite;
(f) an effective amount of said enzyme or enzyme mixture;
(g) the enzyme stabilizing system containing, based on the weight of the detergent composition, (i) from about 1 to 5% glycerine (ii) from about 1 to 5% of an alkali metal borate and (iii) from about 0.5 to 4% of said carboxylic acid compound; and
(h) the balance comprising water and optionally minor adjuvants

15. A method according to claim 14 wherein said alkali metal alkylbenzene sulfonate is sodium linear tridecylbenzene sulfonate and said alkali metal alkyl polyethoxy sulfate is one wherein the alkali metal is sodium, the alkyl group contains 12 to 15 carbon atoms and the polyethoxy is of about 3 ethylene oxide groups.

16. A method according to claim 15 wherein the ratio of tridecylbenzene sulfonate to polyethoxy sulfate is from about 2:1 to about 4:1.

17. A method according to claim 14 wherein said boron compound is borax.

18. A method according to claim 14 wherein the liquid detergent composition contains from about 8 to 16% sodium tripolyphosphate and from about 2 to 6% sodium carbonate, sodium bicarbonate or mixtures thereof;

19. A method according to claim 14 wherein the carboxylic acid compound is aspartic acid or a water-soluble salt thereof.

20. A method according to claim 14 wherein the carboxylic acid compound is citric acid or a water-soluble salt thereof.

21. A method according to claim 14 wherein the carboxylic acid compound is malic acid or a water-soluble salt thereof.

22. A method according to claim 14 wherein the carboxylic acid compound is malonic acid or a water-soluble salt thereof.

* * * * *